US009770622B2

(12) United States Patent
Campanaro et al.

(10) Patent No.: US 9,770,622 B2
(45) Date of Patent: Sep. 26, 2017

(54) ROWING EXERCISE DEVICE AND METHOD OF USING SAME

(71) Applicant: Total Gym Global Corp., San Diego, CA (US)

(72) Inventors: Thomas J. Campanaro, Rancho Santa Fe, CA (US); Jesse Thomas Campanaro, San Diego, CA (US); Dan McCutcheon, San Diego, CA (US)

(73) Assignee: TOTAL GYM GLOBAL CORP, San Diego, CA (US)

( * ) Notice: Subject to any disclaimer, the term of this patent is extended or adjusted under 35 U.S.C. 154(b) by 32 days.

(21) Appl. No.: 14/878,157

(22) Filed: Oct. 8, 2015

(65) Prior Publication Data

US 2016/0107023 A1 Apr. 21, 2016

Related U.S. Application Data

(60) Provisional application No. 62/066,731, filed on Oct. 21, 2014.

(51) Int. Cl.
*A63B 69/06* (2006.01)
*A63B 21/068* (2006.01)
(Continued)

(52) U.S. Cl.
CPC .... *A63B 22/0076* (2013.01); *A63B 21/00065* (2013.01); *A63B 21/023* (2013.01);
(Continued)

(58) Field of Classification Search
CPC ..... A63B 21/00043; A63B 21/00065; A63B 21/00069; A63B 21/005; A63B 21/008;
(Continued)

(56) References Cited

U.S. PATENT DOCUMENTS 339,638 A * 4/1886 Goldie ..... A63B 21/068 482/96
1,866,868 A * 7/1932 Hardy ..... A63B 22/0076 482/72
(Continued)

OTHER PUBLICATIONS

International Search Report and Written Opinion for International Application No. PCT/US2015/055010 mailed on Dec. 14, 2015 in 12 pages.
(Continued)

*Primary Examiner* — Joshua Lee
(74) *Attorney, Agent, or Firm* — Procopio Cory Hargreaves and Savitch LLP; Stephen C. Beuerle

(57) ABSTRACT

A rowing exercise device comprises a support structure; a movable user support movably associated with the support structure for movement relative to the support structure; a movable foot support movably associated with the support structure for movement relative to the support structure; a handle; and a rowing assembly operatively associated with the handle and at least the movable foot support to cause at least the movable foot support to move relative to the support structure with movement of the handle so that both a user s body and one or both feet move relative to the support structure with movement of the handle.

16 Claims, 16 Drawing Sheets

(51) Int. Cl.

| | |
|---|---|
| ***A63B 21/00*** | (2006.01) |
| ***A63B 22/00*** | (2006.01) |
| ***A63B 21/02*** | (2006.01) |
| ***A63B 21/04*** | (2006.01) |
| *A63B 21/005* | (2006.01) |
| *A63B 21/008* | (2006.01) |
| *A63B 21/22* | (2006.01) |

(52) U.S. Cl.
CPC ..... *A63B 21/0428* (2013.01); *A63B 21/068* (2013.01); *A63B 21/154* (2013.01); *A63B 22/0023* (2013.01); *A63B 22/0087* (2013.01); *A63B 21/005* (2013.01); *A63B 21/008* (2013.01); *A63B 21/00069* (2013.01); *A63B 21/0084* (2013.01); *A63B 21/225* (2013.01); *A63B 2022/0035* (2013.01); *A63B 2022/0079* (2013.01)

(58) Field of Classification Search
CPC ..... A63B 21/0084; A63B 21/023; A63B 21/0428; A63B 21/068; A63B 21/151; A63B 21/154; A63B 21/225; A63B 21/4035; A63B 21/4045; A63B 22/0076; A63B 22/0087; A63B 22/0089; A63B 2022/0079; A63B 69/06; A63B 2069/062; A63B 22/0023; A63B 22/201; A63B 22/208; A63B 2022/0035; A63B 22/205; A63B 2022/008; A63B 2022/0084; A63B 2022/206; A63B 21/4031
See application file for complete search history.

(56) References Cited

U.S. PATENT DOCUMENTS

| | | | | |
|---|---|---|---|---|
| D251,079 | S | 2/1979 | Shugarman | |
| D284,597 | S | 7/1986 | Smith | |
| 4,743,010 | A * | 5/1988 | Geraci | A63B 22/0076 482/72 |
| 4,743,011 | A | 5/1988 | Coffey | |
| 5,029,848 | A * | 7/1991 | Sleamaker | A63B 21/068 482/55 |
| 5,072,929 | A | 12/1991 | Peterson et al. | |
| 5,354,251 | A * | 10/1994 | Sleamaker | A63B 21/156 482/142 |
| D362,700 | S | 9/1995 | Breibart et al. | |
| D382,319 | S | 8/1997 | Gerschefske et al. | |
| 5,833,256 | A | 11/1998 | Gilmore | |
| D405,132 | S | 2/1999 | Westfall et al. | |
| 6,120,425 | A | 9/2000 | Endelman | |
| 6,371,895 | B1 | 4/2002 | Endelman et al. | |
| 6,440,045 | B1 | 8/2002 | Gaston | |
| D493,853 | S | 8/2004 | Campanaro et al. | |
| D556,274 | S | 11/2007 | Morgan | |
| D608,401 | S | 1/2010 | Campanaro et al. | |
| D612,000 | S | 3/2010 | Campanaro et al. | |
| 8,033,971 | B2 | 10/2011 | Campanaro et al. | |
| 8,075,457 | B2 | 12/2011 | Campanaro et al. | |
| D659,205 | S | 5/2012 | Endelman et al. | |
| 8,323,157 | B2 | 12/2012 | Campanaro et al. | |
| D694,347 | S | 11/2013 | Campanaro et al. | |
| D703,279 | S | 4/2014 | Ho | |
| 8,702,575 | B2 | 4/2014 | McVay et al. | |
| D726,263 | S | 4/2015 | Anderson | |
| 2001/0056011 | A1 | 12/2001 | Endelman et al. | |
| 2002/0132706 | A1 * | 9/2002 | Sleamaker | A63B 21/068 482/51 |
| 2005/0070181 | A1 | 3/2005 | Bleicken | |
| 2006/0019806 | A1 | 1/2006 | Mikulski | |
| 2008/0280736 | A1 | 11/2008 | D'Eredita | |
| 2009/0163323 | A1 | 6/2009 | Bocchicchio | |
| 2010/0227748 | A1 | 9/2010 | Campanaro et al. | |
| 2011/0028278 | A1 * | 2/2011 | Roach | A63B 22/0076 482/72 |
| 2011/0082015 | A1 | 4/2011 | Dreissigacker et al. | |
| 2012/0053028 | A1 | 3/2012 | Campanaro et al. | |
| 2012/0100965 | A1 * | 4/2012 | Dreissigacker | A63B 21/0088 482/72 |
| 2014/0141948 | A1 | 5/2014 | Aronson et al. | |
| 2014/0194260 | A1 | 7/2014 | Campanaro et al. | |

OTHER PUBLICATIONS

First office action for Chinese patent application No. 201530107957.1 mailed on Jul. 17, 2017 in 1 page.

* cited by examiner

ROWING EXERCISE DEVICE AND METHOD OF USING SAME

CROSS-REFERENCE TO RELATED APPLICATIONS

This application claims priority to U.S. Provisional Patent Application No. 62/066,731, filed on Oct. 21, 2014, which is incorporated by reference herein.

FIELD OF THE INVENTION

The present invention relates to a rowing exercise device.

SUMMARY OF THE INVENTION

An aspect of the invention involves a rowing exercise device. The rowing exercise device comprises a support structure; a movable user support movably associated with the support structure for movement relative to the support structure; a movable foot support movably associated with the support structure for movement relative to the support structure; a handle; a rowing assembly operatively associated with the handle and at least the movable foot support to cause at least the movable foot support to move relative to the support structure with movement of the handle so that both a user's body and feet move relative to the support structure with movement of the handle.

One or more implementations of the aspect of the invention described immediately above include one more of the following: The movable user support and the movable foot support are independent of each other. The support structure includes one or more inclined rails so that exercise resistance is provided at least in part by a user's bodyweight. The one or more inclined rails are at least one of entirely straight, partially curved, fixed, and adjustable. The rowing assembly includes at least one of one or more cables, one or more pulleys, may or may not include one or more levers, may or may not include one or more cams, and may or may not include one or more gears operatively associated with the handle and at least the movable foot support to provide concentric and eccentric exercise with movement of the handle. The movable user support is at least one of a seat, a glide board, and a sliding platform. The support structure one or more rails with opposite ends and the movable foot support is lockable to the one or more rails adjacent to one of the opposite ends so that the rowing exercise device can be stored by standing it up on its end adjacent to the movable foot support. The handle includes a pair of handles, one for each hand of a user (not limited to the rigidly connected bar type handle. Independent handles on cables can be done). The movable foot support includes a pair of movable foot supports (e.g., foot pedals that pedal like a bicycle's foot pedals), one for each foot of a user. The rowing assembly includes one or more cables that terminate at one or more of the following: both ends terminate to the handle, or the seat, or foot support or rail support structure. One or more cables may terminate one end to each moving handle or platform also. The one or more cables include a loop that goes from the frame to the foot support to the handle and back to the seat. The rowing assembly may or may not include one or more resistance increasing mechanisms to increase rowing exercise resistance in the rowing exercise device. The one or more resistance increasing mechanisms include one or more springs, one or more elastic structures, and one or more weight holding structures and one or more weights. The rowing assembly includes one or more dynamic resistance mechanisms. The one or more dynamic resistance mechanisms includes one or more flywheels, one or more electromagnetic devices, one or more hydraulic devices, one or more pneumatic devices, one or more friction devices, and one or more spiral winding pulleys. A mast and at least one cable are operably associated with the handle and the rowing assembly extending through the mast. The mast is at least one of a vertical mast, an angled mast, and a long mast. A method of rowing using the rowing exercise device comprises supporting one's body on the movable user support with the movable user support in a mount and dismount position; receiving one's feet with one's legs bent on the movable foot support with the movable foot support in a mount and dismount position; receiving one's hands with one's arms substantially straight on the handle assembly; the rowing assembly causing the movable foot support receiving one's feet to move from the mount and dismount position to a finish position, relative to the support structure, providing concentric rowing exercise, by one pulling on the handle assembly with one's hands and bending one's arms; the movable user support moving from the mount and dismount position to a finish position by one extending one's legs as the movable foot support moves, causing the movable user support to move away from the movable foot support. The method further includes the rowing assembly causing the movable foot support receiving one's feet to move from the finish position to the mount and dismount position, relative to the support structure, providing eccentric rowing exercise, by straightening one's arms while holding onto the handle assembly with one's hands; the movable user support moving from the finish position to the mount and dismount position by one bending one's legs as the movable foot support moves, causing the movable user support to move towards from the movable foot support. The support structure is at an incline relative to horizontal so that both concentric and eccentric rowing resistance in the rowing exercise device is provided by substantially entirely bodyweight resistance.

DETAILED DESCRIPTION OF PREFERRED EMBODIMENTS

Figure 1:
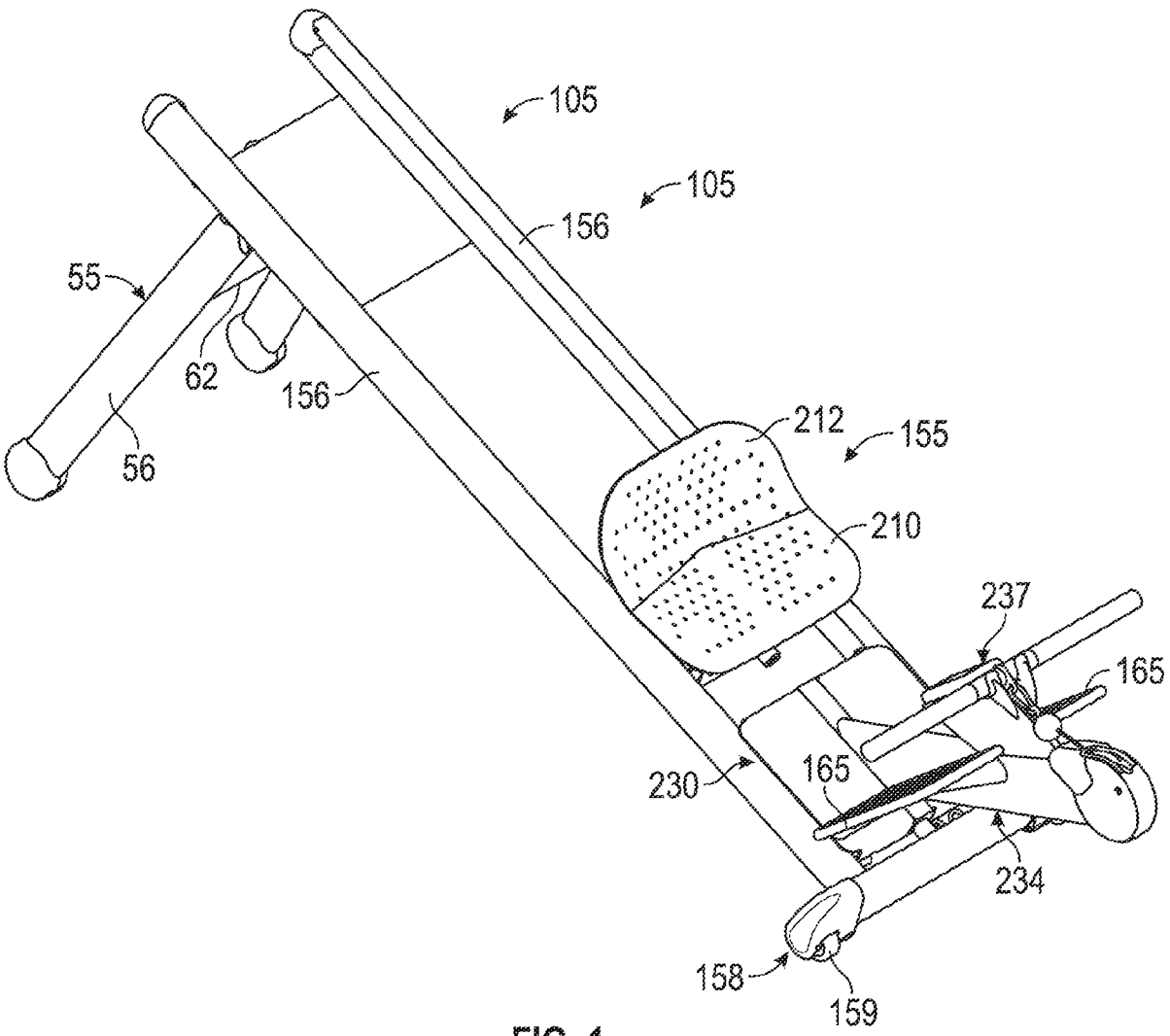
FIG. 1 is a front perspective view of an embodiment of a rowing exercise device.
Figure 2:
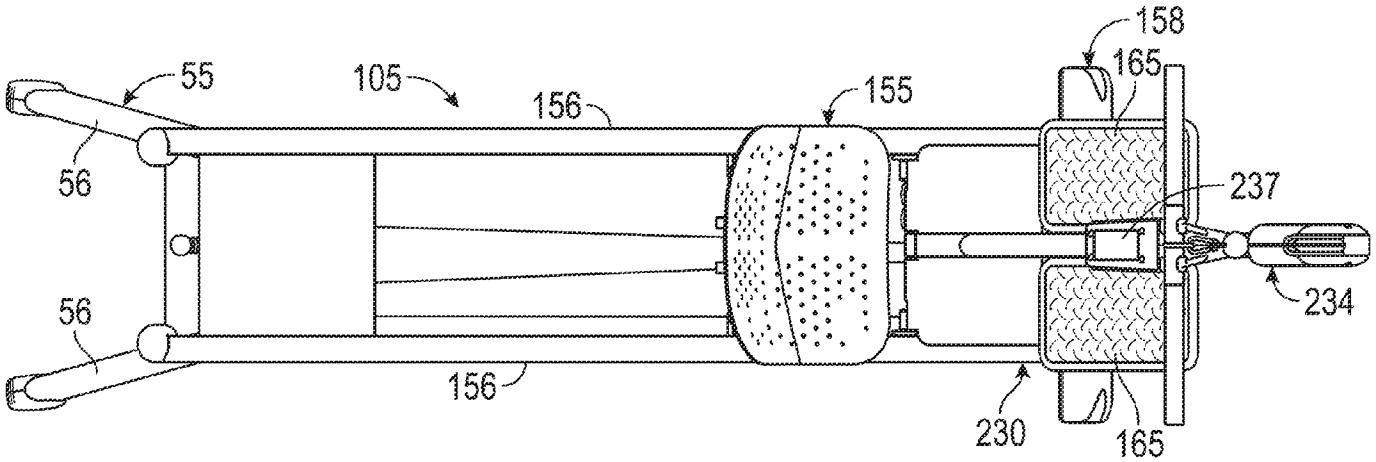
FIG. 2 is a top plan view of the rowing exercise device of FIG. 1.
Figure 3:
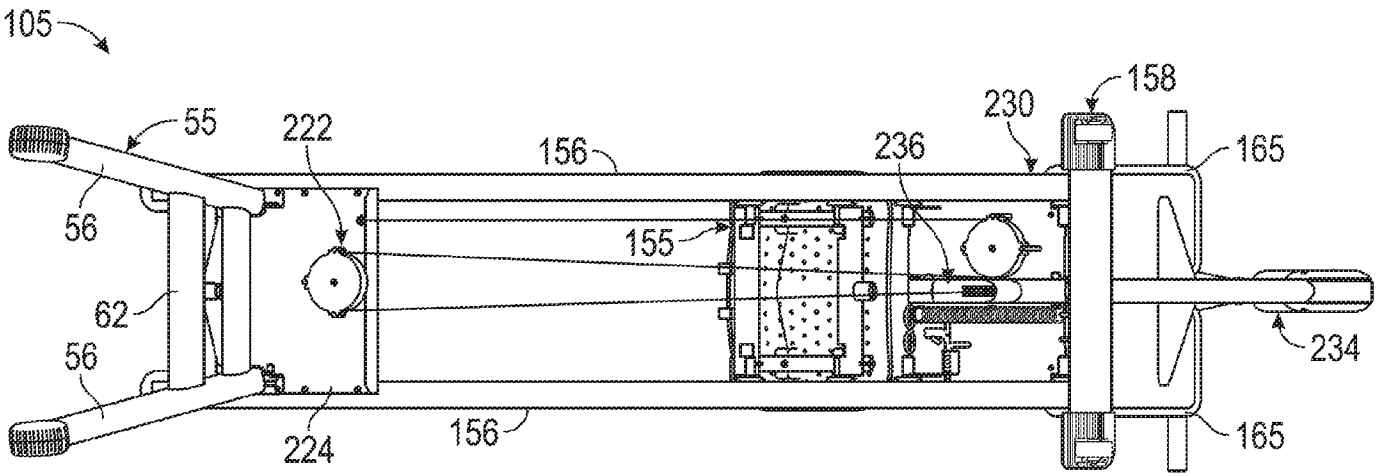
FIG. 3 is a bottom plan view of the rowing exercise device of FIG. 1.
Figure 5:
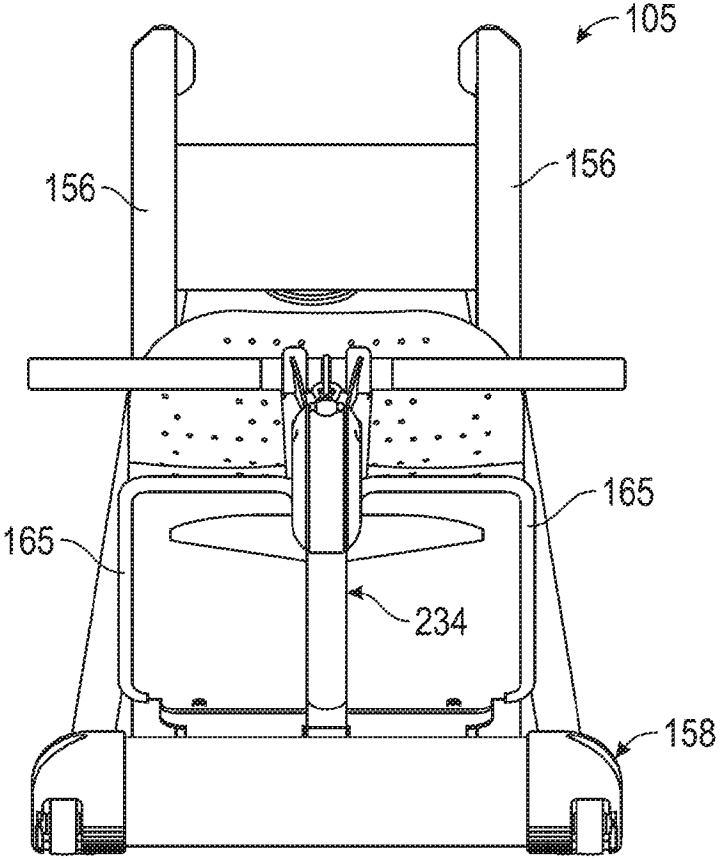
FIG. 5 is a front elevation view of the rowing exercise device of FIG. 1.
Figure 4:
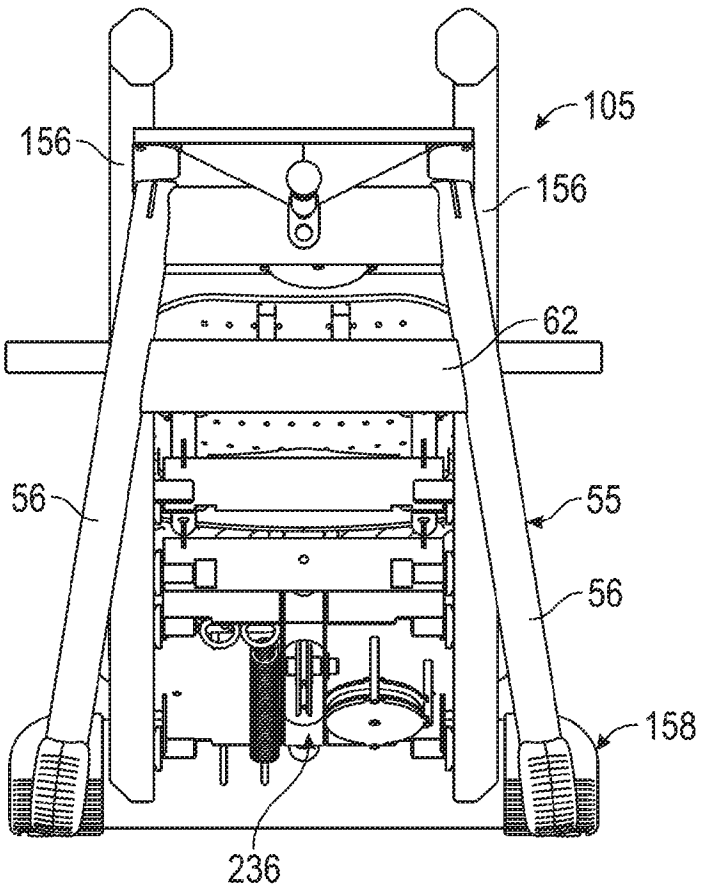
FIG. 4 is a rear elevation view of the rowing exercise device of FIG. 1. 1.
Figure 6:
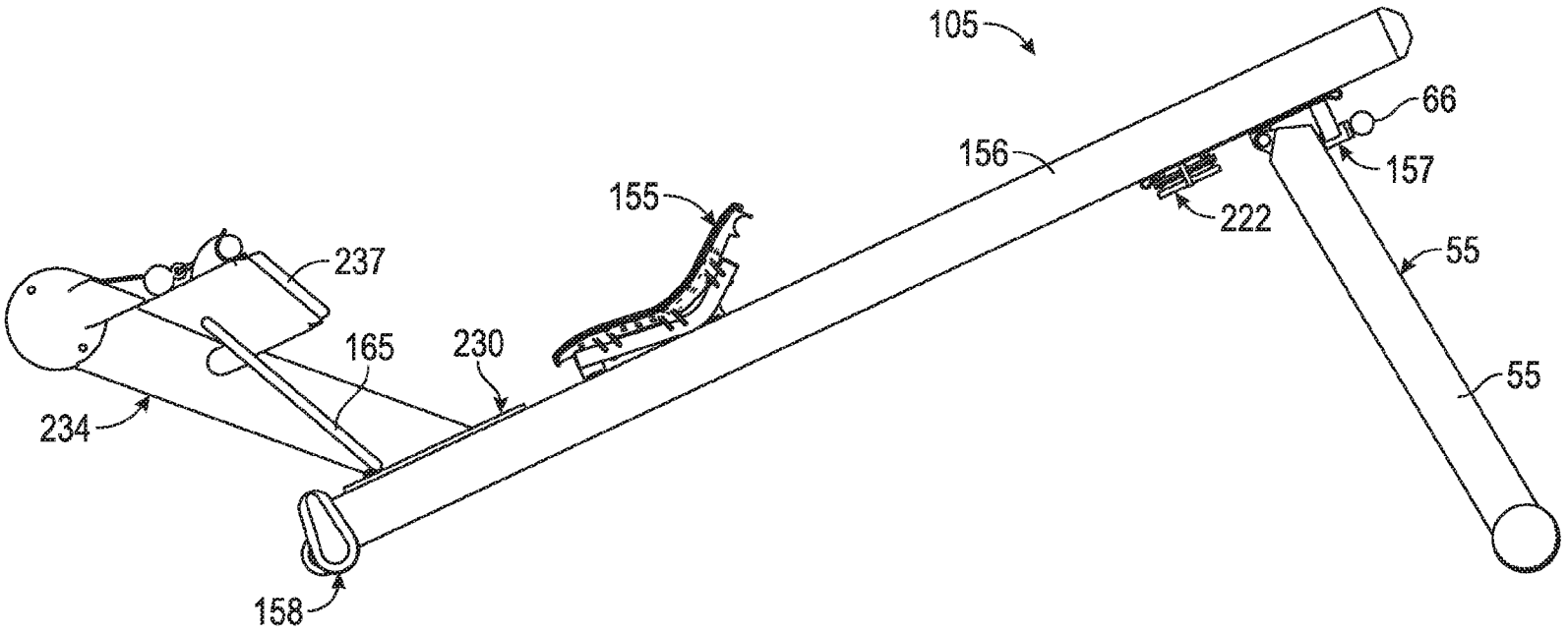
FIG. 6 is a right side elevation view of the rowing exercise device of FIG. 1. 1.

With reference initially to FIGS. 1-7B, an embodiment of a rowing exercise device 105 will be described.

The rowing exercise device 105 comprises a movable user support (e.g., seat) 155 including a lower relatively flat section 210 and an upper angled section 212 rollably mounted via rollers 231 on a support structure 154. The support structure 154 shown includes a pair of inclined rails 156 secured to a cross bar 158 at their lower ends and supported in an inclined orientation at a selected inclination angle by an adjustable support assembly 55.

The adjustable support assembly 55 supports the rails 156 and is adjustable so that the rails 156 extend at a desired inclination angle (e.g., high incline (FIG. 7A), low incline (FIG. 7B)) to provide a desired resistance. Adjustable support assembly 55 comprises legs 56 and a cross bar 62 extending between the legs 56. At its upper end, adjustable support assembly 55 is pivotally connected to the rails 156 at pivot 63. A spring loaded locking pin 157 actuated by knob 66 is used to lock the adjustable support assembly 55 at the desired inclination angle. A user can simply actuate the knob 66 to release the locking pin 157, and then adjust the angle of the adjustable support assembly 55 and, then, release the knob 66 to lock the adjustable support assembly 55 at the desired inclination angle.

At an opposite end of the exercise device 105 is a cross bar 158 coupled to the lower ends of the rails 156. The cross bar 158 includes wheels 159 to allow the user to roll the exercise device 105 around the room. The wheels 159 may be part of a collapsible suspension wheel assembly where the suspension wheels 159 are urged downwardly relative to the base strut by respective spring assemblies so that the wheels 159 go up and down in unison. The suspension wheels 159 retract up into the cross bar 158 when a user is on the exercise device 105, but deploy downward when the user is not on the exercise device 105. When the wheels 159 are deployed, a user can slide or roll the exercise device 105 across a room by lifting up on the opposite side of the exercise device 105 and pulling or pushing the exercise device 105 to cause the exercise device 105 to roll around the room.

Figure 10:
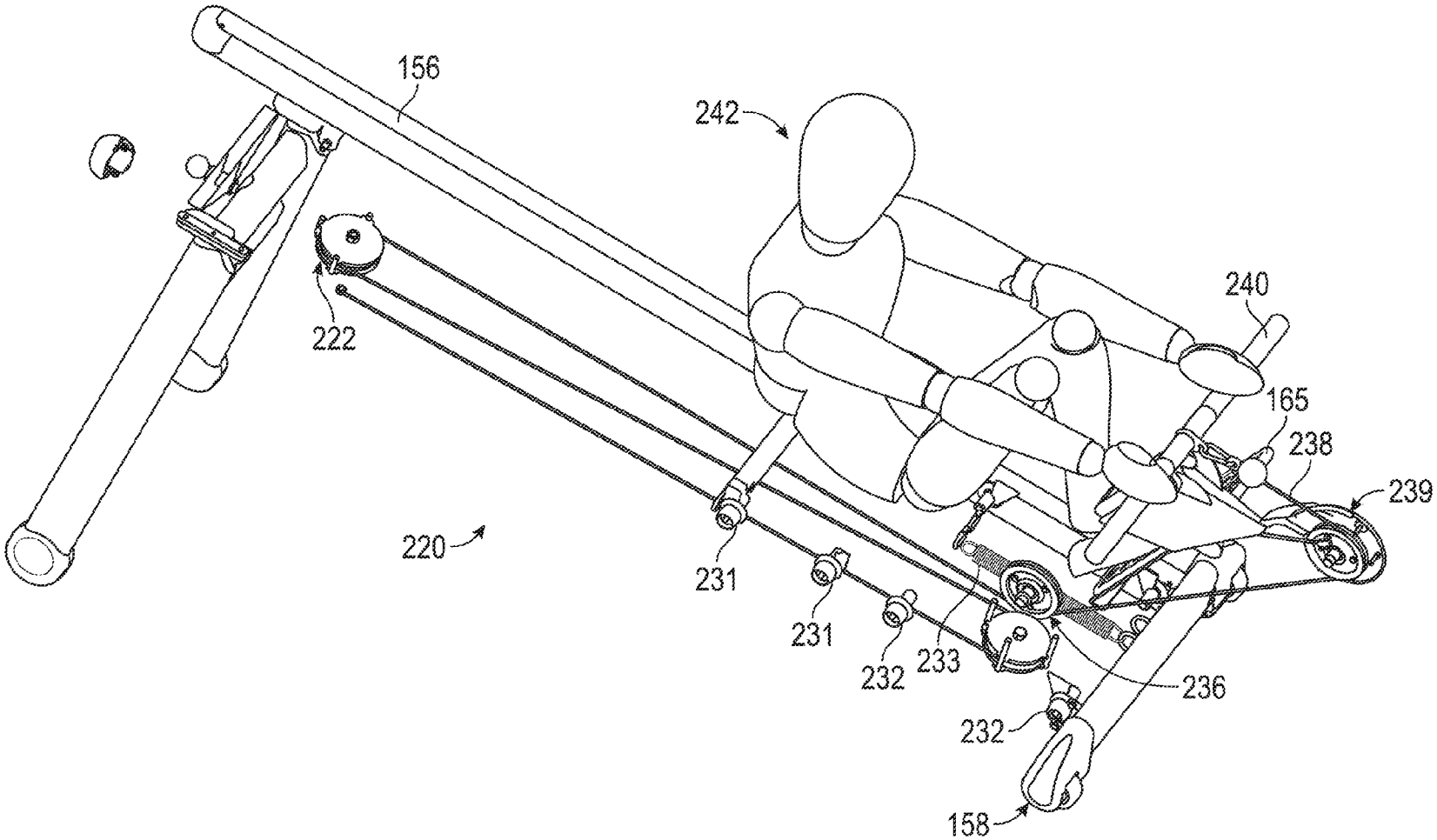
FIG. 10 is a perspective view of components of a rowing system of the rowing exercise device of FIG. 1 and shows a user in a lower start position.
Figure 11:
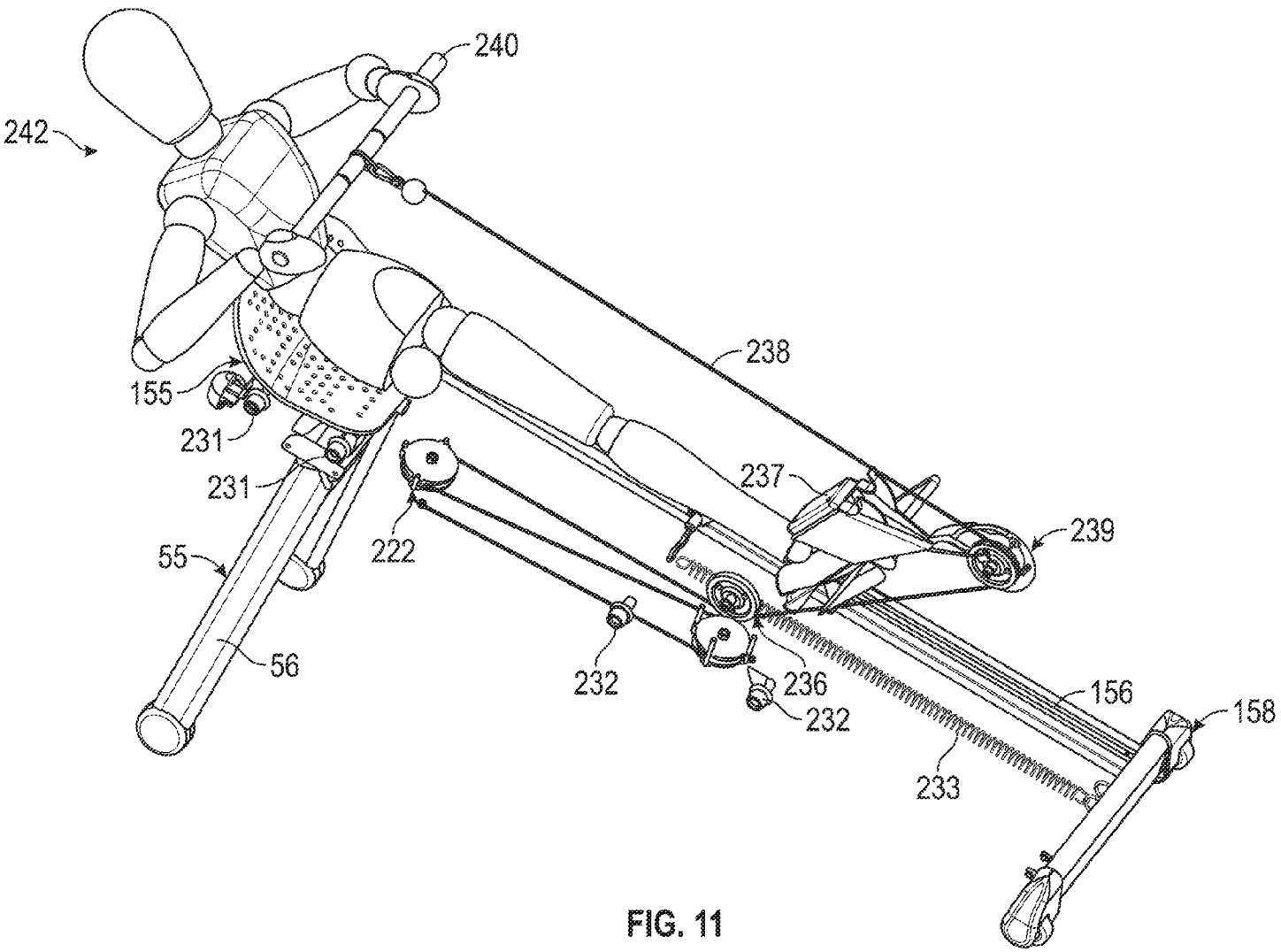
FIG. 11 is a perspective view of components of a rowing system of the rowing exercise device of FIG. 1 and shows a user in an upper finish position.
Figure 12:
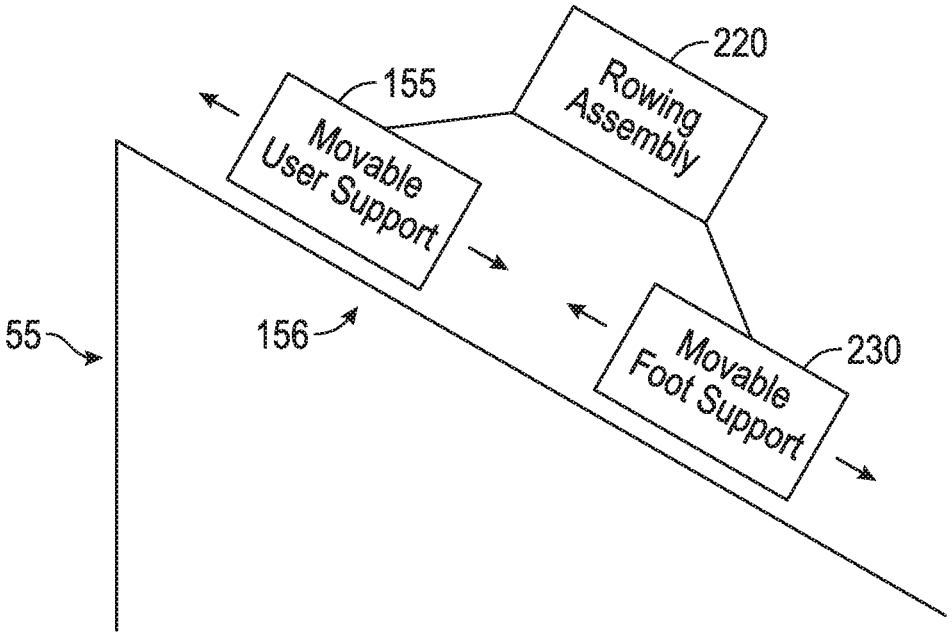
FIG. 12 is a simplified schematic of an embodiment of a rowing exercise device.
Figure 13:
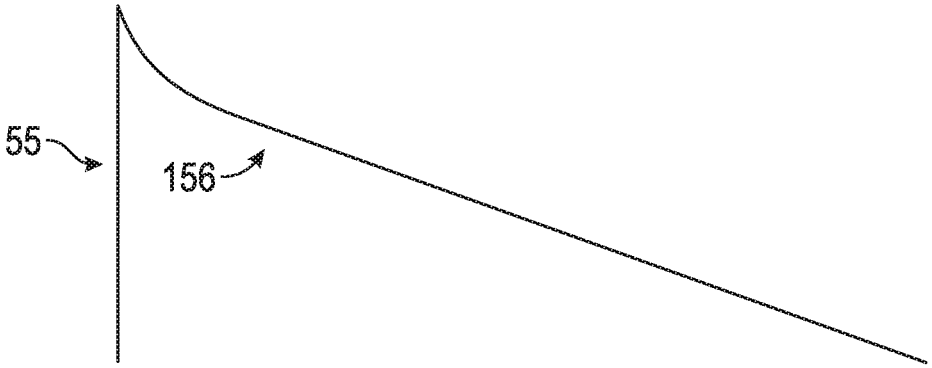
FIG. 13 is a simplified right side elevation view of an embodiment of a rowing exercise device with variable incline rail(s)
Figure 14:
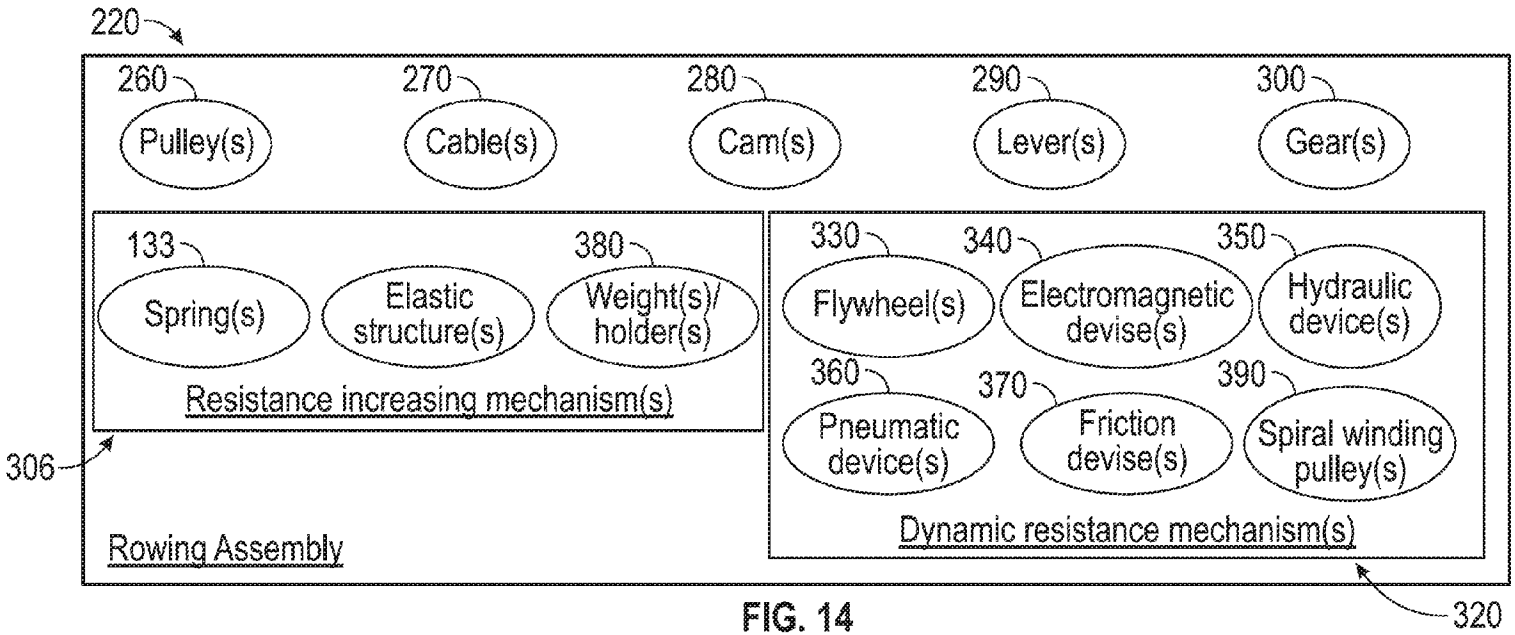
FIG. 14 is a simplified schematic of one or more embodiments of a rowing assembly of the rowing exercise device.
Figure 15:
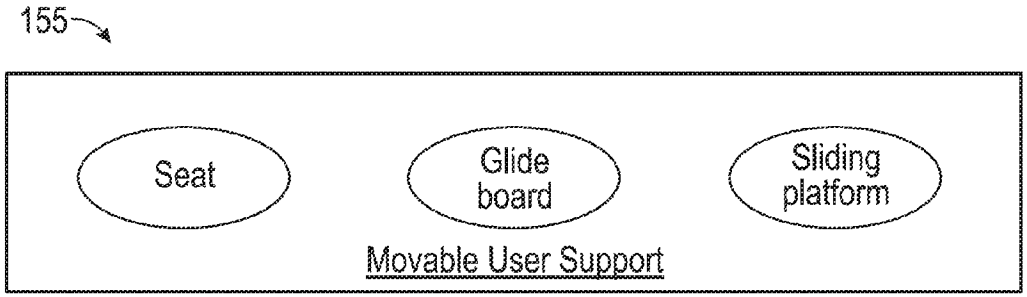
FIG. 15 is a simplified schematic of one or more embodiments of a movable user support of the rowing exercise device.
Figure 16:
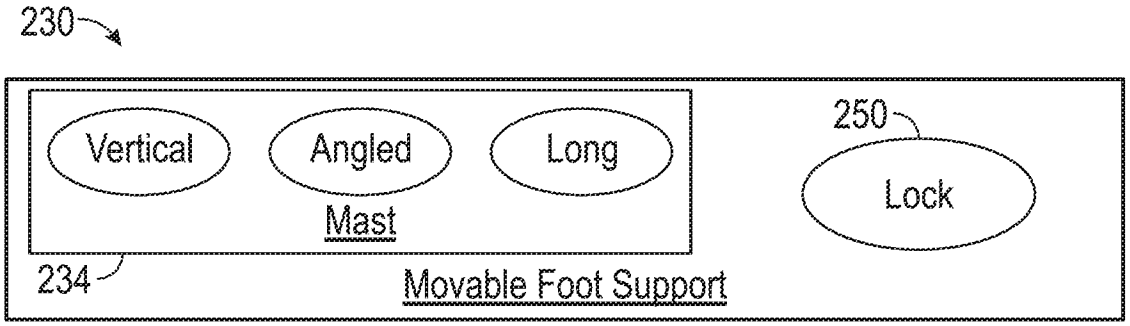
FIG. 16 is a simplified schematic of one or more embodiments of a movable foot support of the rowing exercise device.
Figure 17:
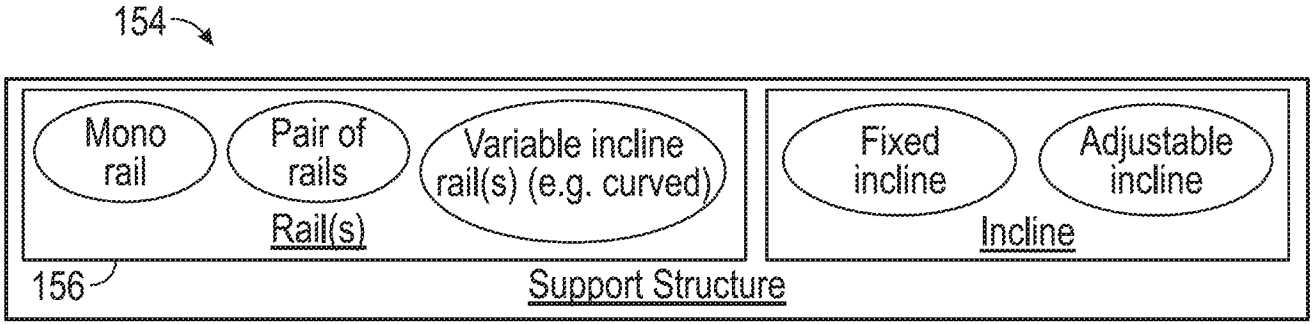
FIG. 17 is a simplified schematic of one or more embodiments of a support structure of the rowing exercise device.
Figure 18:
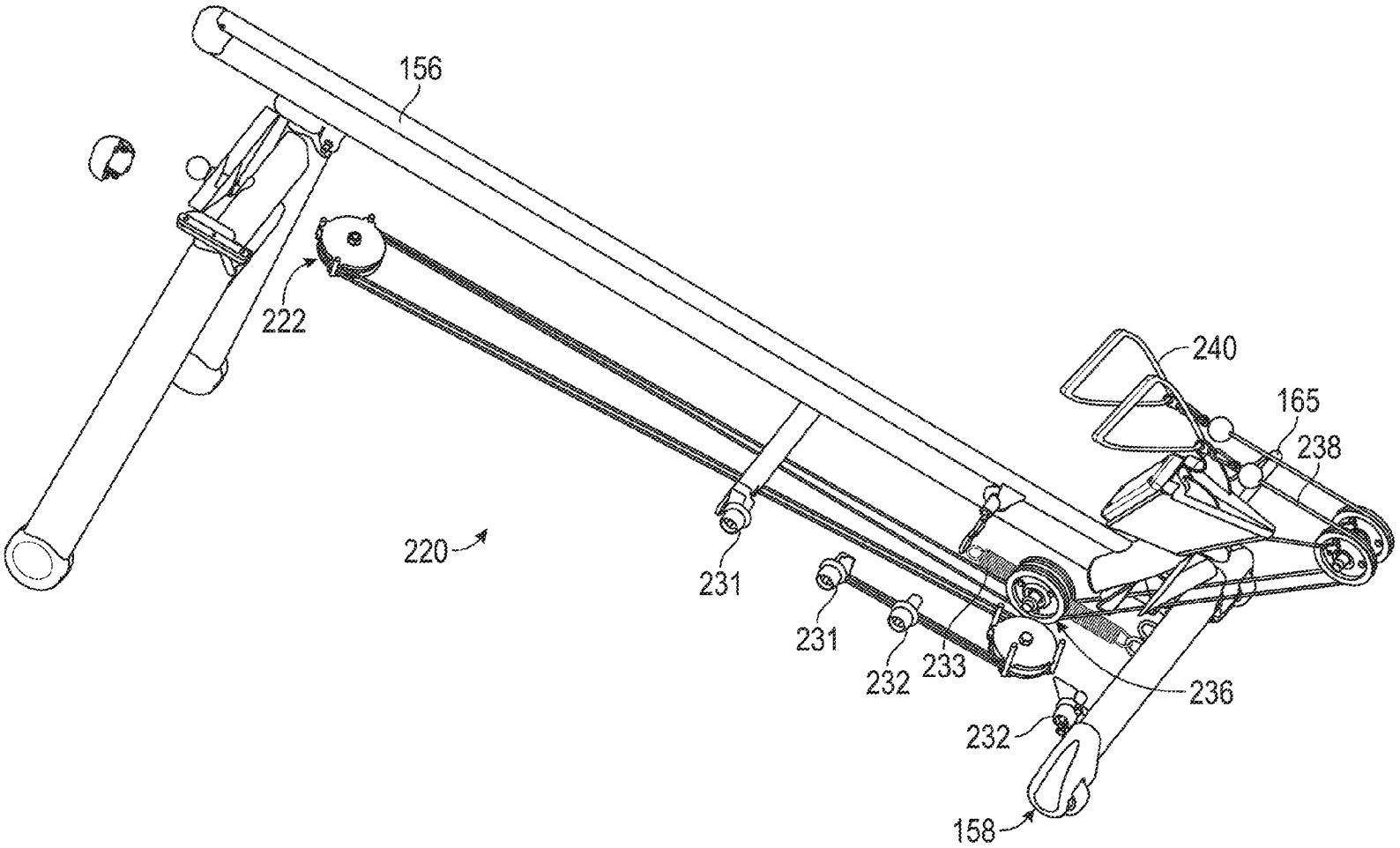
FIG. 18 is a perspective view of components of another embodiment of a rowing exercise device and shows some of the components in a lower start position.
Figure 19:
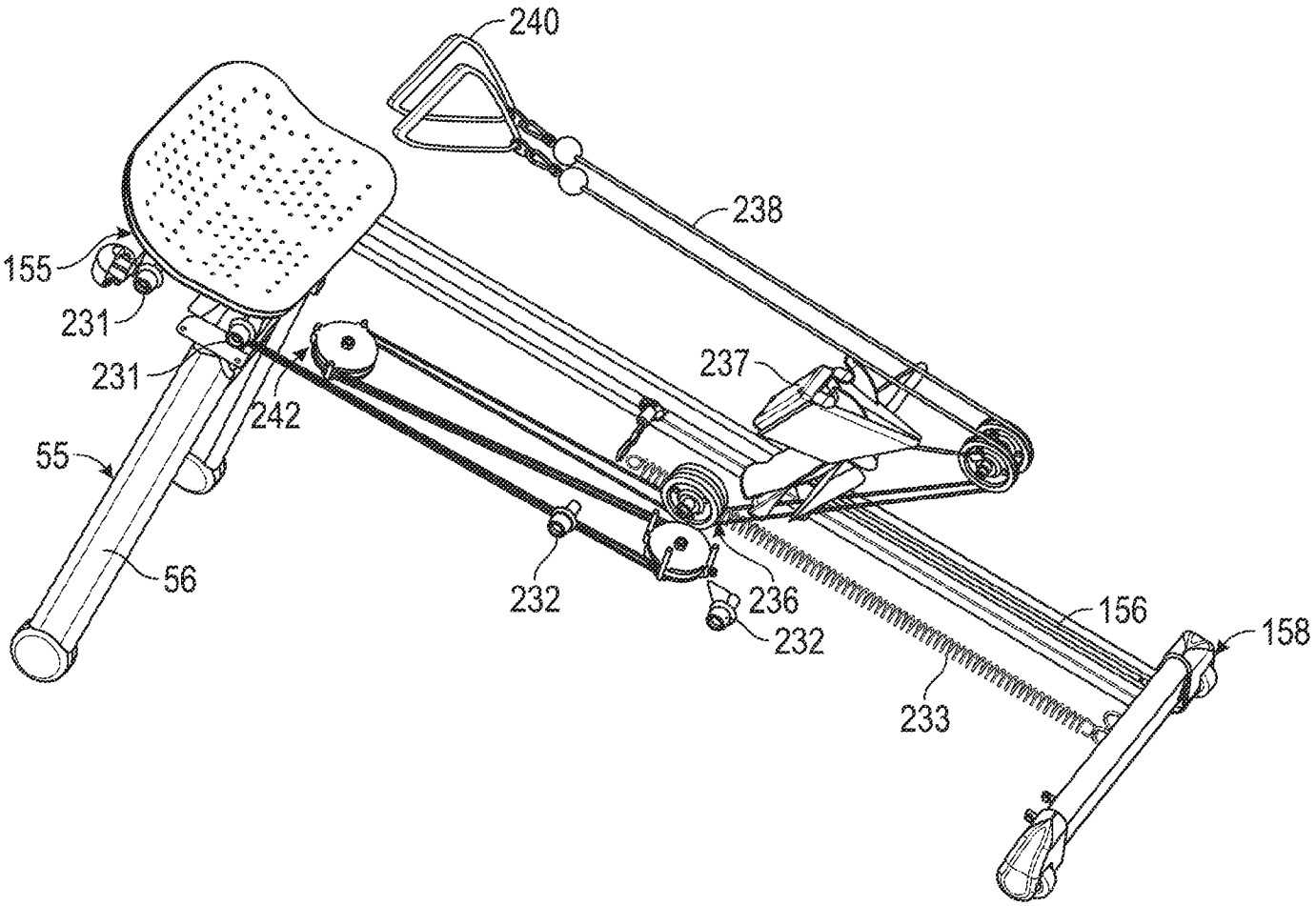
FIG. 19 is a perspective view of components of the rowing exercise device of FIG. 18 and shows some of the components in an upper finish position.

With reference additionally to FIGS. 10 and 11, which shows a user 212 and many of the components of the rowing exercise device 105 not shown, a rowing assembly 220 will be described. The rowing assembly 220 includes a fixed upper pulley 222 and end of the cable 238 secured to a fixed upper support 224. FIGS. 18 and 19 show an end of the cable secured to where a front of a seat/carriage would be instead of being secured to the fixed upper support 224. A movable foot support (e.g., foot carriage) 230 moves along the rails 156 via rollers 232. As best shown in FIG. 11, one or more springs 233 are connected at one end to an underside of the movable foot support 230 and at an opposite end to the cross bar 158. The one or more springs 133 increase rowing resistance, especially at the end of the range of motion shown in FIG. 11. The movable foot support 230 includes an angled support tower/mast 234. The angled support tower 234 houses second pulley 236 and top/third pulley 239, supports a pair of fixed external foot plates/pedals 165 on opposite sides of the tower 234, and carries a computer display assembly 237. In an alternative embodiment, the foot plates 165 are tiltable so that the angle freely adjusts with the orientation of the user's feet on the foot plates 165 to allow for ankle flexion. The display assembly 237 displays basic metrics (e.g., time, speed, distance). In one embodiment, by providing a magnet on the third pulley 239 in FIG. 10, speed is determined by a sensor in the display assembly 237. In an alternative or additional embodiment, by providing a pair of magnets on the third pulley 239 in FIG. 10, stroke length is (or is also) determined by a pair of sensors in the display assembly 237. In an alternative or further embodiment, by providing a load sensor at the fixed upper pulley 222, in conjunction with other measured information, calories burned is determined and displayed by the display assembly 237. A cable 238, which runs through the pulleys 222, 236, includes a handle assembly 240 at one end and is connected to the movable foot support 230 at an opposite end. The handle assembly 240 may be a single straight-bar handle as shown, a single curved handle, a pair of separate handles, one for each hand (e.g., with separate cables), or other row-type of handle.

Figure 7A:
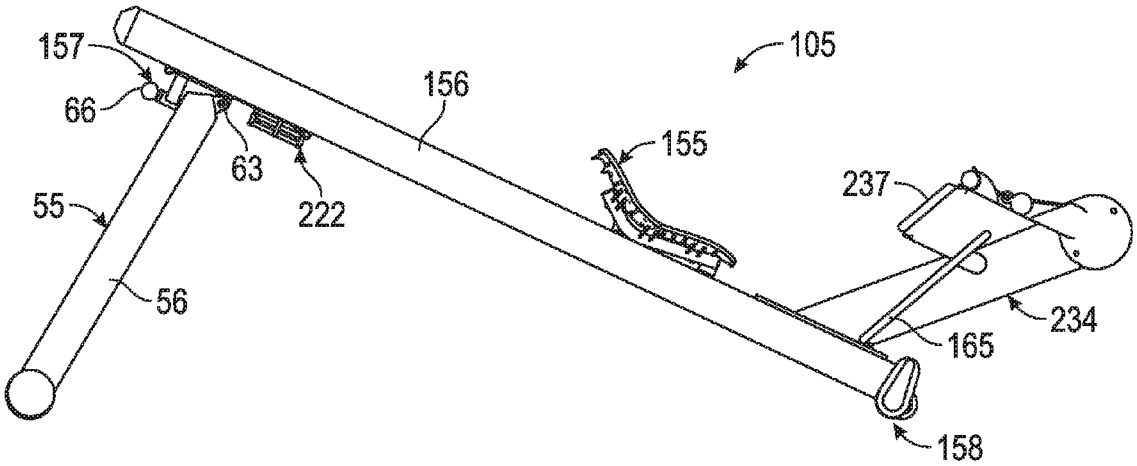
FIGS. 7A and 7B are left side elevation views of the rowing exercise device of FIG. 1 in a high-incline configuration and a low-incline configuration, respectively.
Figure 7B:
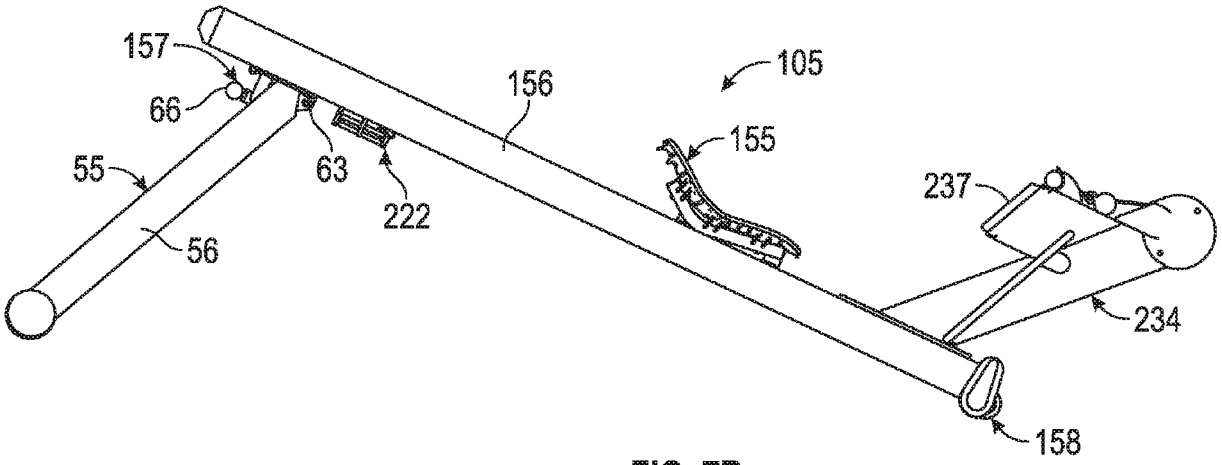

With reference additionally to FIGS. 10 and 11, the rowing exercise device 105 will now be described in use. In FIG. 10, the movable user support 155 is shown in a mount/dismount position. The mount/dismount position is the position of the movable user support 155 and movable foot support 230 where the user 242 gets on the rowing exercise device 105 to start a rowing workout session and gets off the exercise device 105 after a rowing session is completed. In the mount/dismount position shown in FIG. 10, the user 242 is in a crouched position with legs/knees substantially bent, arms substantially straight with hands holding onto the handle assembly 240, and torso substantially perpendicular relative to the rails 156. To row, the user leans rearward, pulls the handle assembly 240 (and cable 238) towards the torso, and pushes against the foot plates 165 with the feet, straightening the legs. As shown in FIG. 11, because the cable 238 is a fixed length, as the length of cable 238 between the handle assembly 240 and the movable foot support 230 increases, the length of cable 238 between the fixed upper pulley 222 and the movable foot support 230 decreases, causing the movable foot support 230 to move up the inclined rails 156 at a rate proportionate to the rate that the user 242 pulls on the handle assembly 240/cable 238. The angle of the rails 156, which may be adjusted, as shown in FIGS. 7A, 7B, determines the amount of resistance (percentage of user's body weight) the user 242 must overcome to pull the movable foot support 230, user 242, and movable user support 155 up the inclined rails 156 to the finish position shown in FIG. 11. As shown in the finish position of FIG. 11, unlike a traditional level/horizontal rowing machine, the inclined nature of the rowing exercise device 105 enables better rowing posture for the user's back because the user's torso is inclined more rearwardly (compared to traditional level/horizontal rowing machine).

To return to the mount/dismount position shown in FIG. 10, the user 242 simultaneously straightens the arms, bends the torso forward, and bends the legs. This causes the length of cable 238 between the handle assembly 240 and the movable foot support 230 to decrease and the length of cable 238 between the fixed upper pulley 222 and the movable foot support 230 to increase, causing the movable foot support 230 to move down the inclined rails 156 to the position shown in FIG. 9. As the user 242 rows, going up and down the inclined rails 156, the user 242 experiences substantially the same amount of resistance both when pulling (going up the rails 156) and returning (going down the rails 156), unlike a traditional level/horizontal rowing machine where substantial resistance only occurs on pulling. Thus, the rowing exercise device 105 is unique in that it is the only entirely bodyweight resistance rowing machine with both eccentric and concentric resistance. While rowing, the user's feet are moving because the foot plates 165 are moving up and down the rails 156. The user's movement up and down the rails 156 gives the user 242 a unique "riding" experience.

Figure 8:
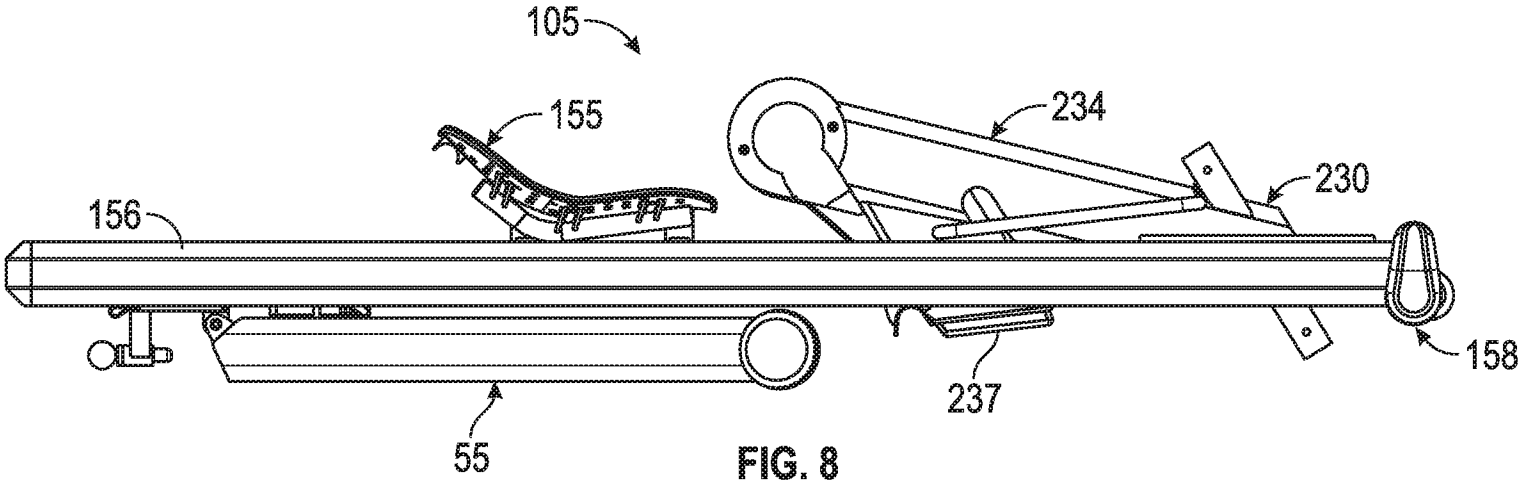
FIG. 8 is a left side elevation view of the rowing exercise device shown in a shipping/packaging configuration.

FIG. 8 shows the rowing exercise device 105 in a shipping/packaging configuration (e.g., configuration for shipping/transporting rowing exercise device 105). In this configuration, the angled support tower 234 is substantially parallel with the rails 156, with the display assembly 237 disposed downwardly.

Figure 9:
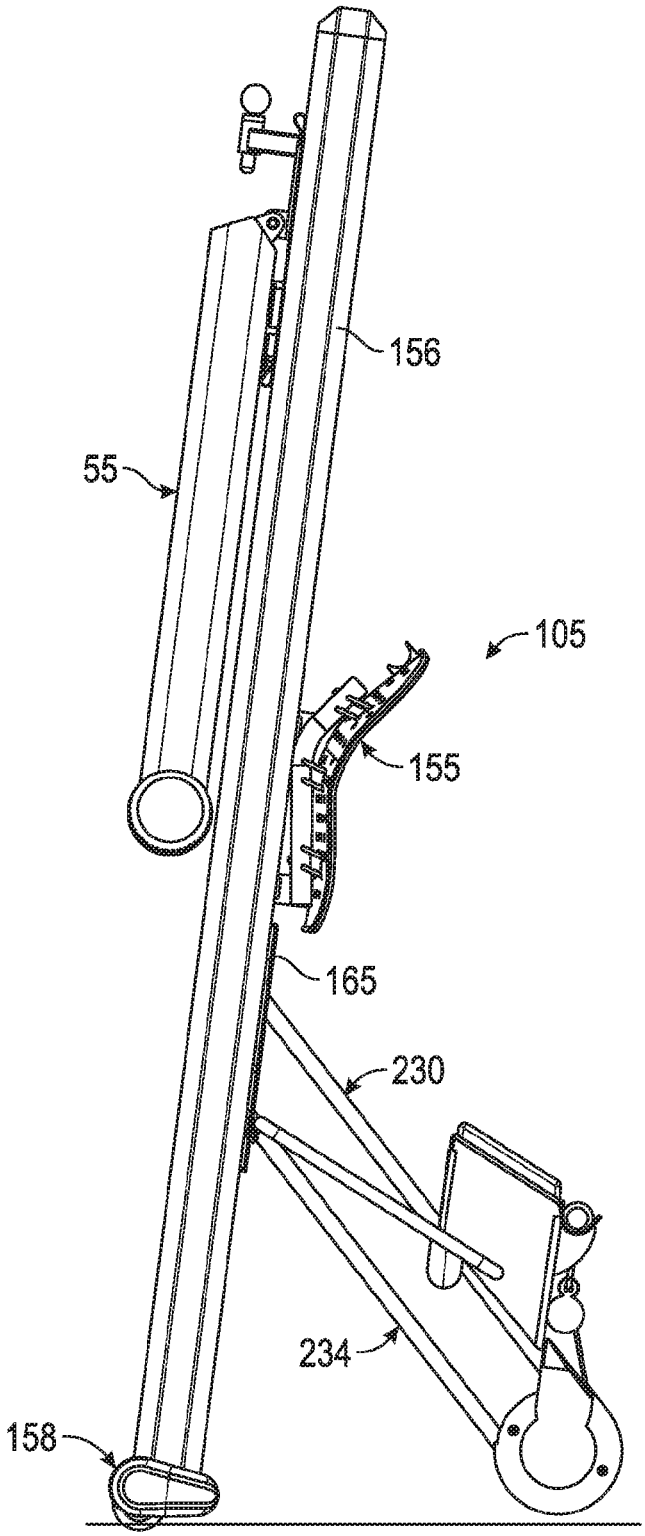
FIG. 9 is a side elevation view of the rowing exercise device shown in a storage configuration.

FIG. 9 shows the rowing exercise device 105 in a storage configuration, where the rowing exercise device 105 is supported on a level surface by cross bar 158 and upper end of the angled support tower 234. In this configuration, the adjustable support assembly 55 is pivoted forward and locked, adjacent to and parallel with the support rails 156.

Figure 20:
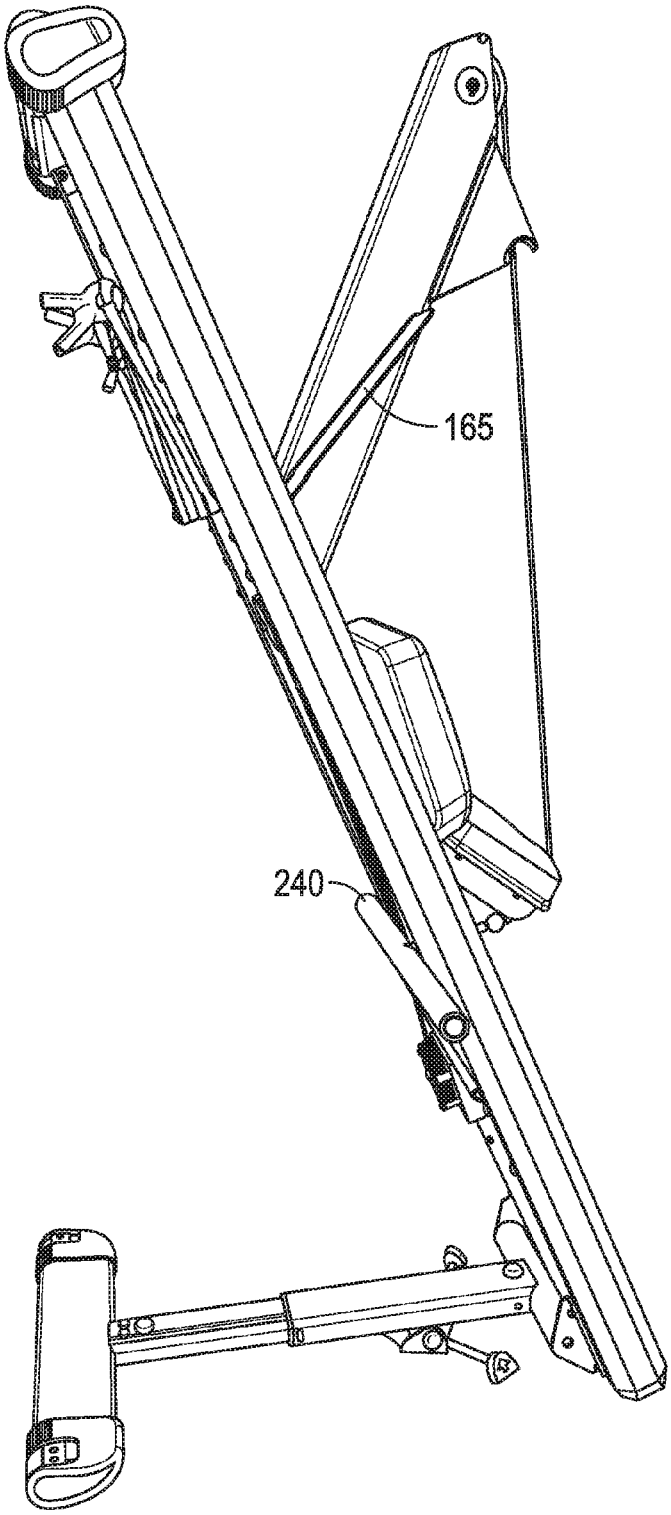
FIG. 20 is a side elevation view of another embodiment of a rowing exercise device and shows the rowing exercise device in an alternative storage configuration compared to FIG. 9 and shows a stored handle.

FIG. 20 shows an alternative rowing exercise device storage configuration, where the rowing exercise device is supported on a level surface by the adjustable support assembly and an end of the rail(s).

The rowing exercise device 105 provides a number of advantages compared to rowing exercise devices in the past:

1. Two independent slidable/rollable/movable support platforms (e.g., seat 105, movable foot support 230 on incline rail(s) work together through the motion of relative body positions of the feet and seat in any ratio or variable ratios of handle motion to feet motion to provide resistance. This may be achieved by any number of cables, pulleys, levers, and any combinations.

2. Motion of full body (feet moving in addition to the body moving during the rowing motion) is more fun and provides a sensation that is more exciting than rowers with fixed feet positions.

3. Concentric and eccentric exercise on the rowing exercise device 105 is healthier than typical concentric only repetitive sports mimicking motion with rowers with fixed feet positions.

4. The only rowing machine with both concentric and eccentric load with or without one's bodyweight as the resistance.

Figure 21:
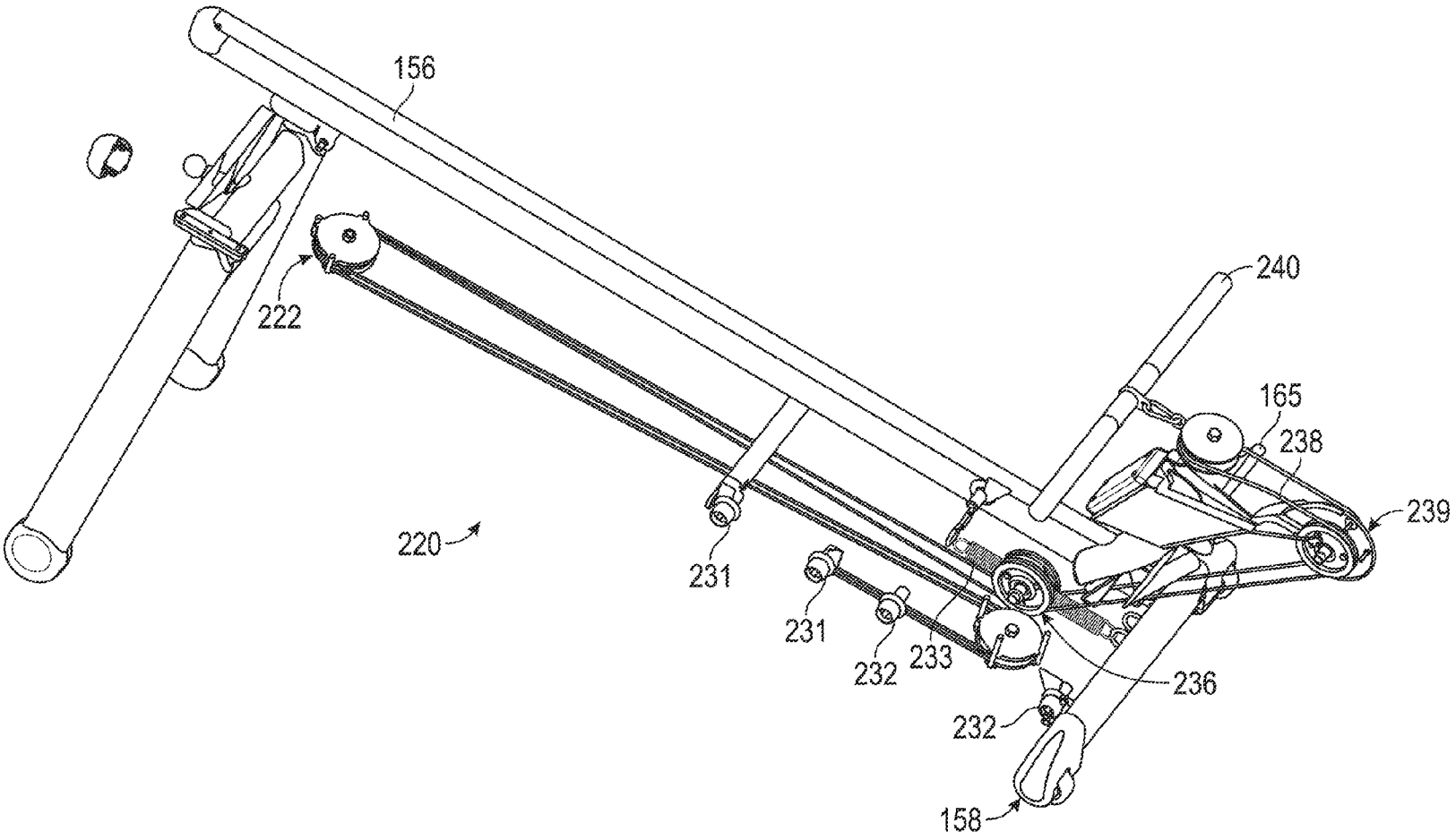
FIG. 21 is a perspective view of components of another embodiment of a rowing exercise device and shows a cable of the rowing exercise device terminating at a location other than at a handle assembly.

With reference additional to FIGS. 12-20, one or more embodiments and/or implementations of the rowing exercise device 105 includes one or more of the following. The movable user support 155 is a seat, glide board, or sliding platform. Rail(s) 156 is/are a mono rail, a pair of rails, or other number of rails. The rail(s) 156 is/are curved to change resistance on a variable incline (e.g., allows for progression for exercise to be on different slopes at different points of the rail for different users). The support assembly 55 is not adjustable (e.g., fixed incline). For a fixed incline configuration, wheels 159 on the cross bar 158 may be mounted so they engage when the rear legs 56 are lifted off the ground to roll the rowing exercise device 105 to another place. The cross bar 158 does not include wheels 159. As shown in FIG. 9, the rowing exercise device 105 can be stored by standing it up on its end. The rowing exercise device 105 includes a lock 250 for locking the foot plates/pedals 165 at an optimal position along the rails 156 to stand the rowing exercise device 105 on end for storage. With reference to FIG. 20, the handle assembly 240 can also be used to restrain one or both foot plates/pedals 165 when the rowing exercise device is in a storage configuration for more compact horizontal storage and for easier transportation. The rowing assembly 220 may include more than one upper pulley 222. The rowing assembly 220 may have a number of pulleys (e.g., more or less pulleys), pulley configuration, pulley arrangement, and/or combination of linkages other than that shown to create different ratios of motion between the fixed frame/rail(s) 156, the foot plates/pedals 165, the movable user support 155, and the handle assembly 240. These will also change the loads exerted between the movable user support 155 and feet to increase the effectiveness of the exercise. The rowing assembly 220 can be configured to adjust the ratio of the rate that the user 242 pulls on the handle assembly 240/cable 238 versus the rate that the movable foot support 230 moved up the inclined rail(s) 156 to any ratio. The rowing assembly 220 may have any combination of pulleys 260, cables 270, cams 280, lever 290, gears 300, or other mechanisms to achieve the relative motion of two human push points: seat & feet and one or two pull points with one or both hands in unison or independent with two cables 238 and separate handles 240, as shown in the embodiment of the rowing exercise device in FIGS. 18 and 19. Each separate handle 240 may correspond to a separate cable in the rowing assembly 220 or each handle 240 may attach to a separate cable/link that joins with a single cable in the rowing assembly 220. These combinations create exercise resistance that is comfortable, safe and beneficial. These combinations may be changed or selected by the user for more or less resistance by any of the three load points. As shown in FIG. 21, the cable 238 may terminate at a location other than the handle assembly 240. The spring(s) 133 may be any type of spring such as, but not limited to, torsion spring(s), extension spring(s), and/or compression spring(s). This helps some users achieve more force at the end of the range of motion, but it is dependent on the user's height. Alternatively, the rowing assembly 220 does not include one or more springs 133. The rowing assembly 220 includes one or more weight resistance mechanisms 306 to increase or change the resistance. For example, the rowing assembly 220 may include springs (e.g., torsion spring(s), extension spring(s), compression spring(s)) 133, Bungee elastic cord (s), or one or more other materials to be used as/like springs (e.g., air bag(s), etc.) to different moving structures (e.g., movable user support 155 and/or movable foot support 230) and the fixed frame/rail(s) 156. Bungee resistance aligned with motion, or across, anchored moving or fixed. Bungee resistance varied by user by selecting more or less bands while on or off rowing exercise device 105. Bungee resistance varied by adjusting the stretch distance or leverage with a lever or other controlling device. The rowing assembly 220 may include one or more dynamic velocity dependent force producing devices (i.e., dynamic resistance mechanism(s)) 320 such as flywheel(s) 330, electromagnetic device(s) 340, hydraulic device(s) 350, pneumatic device(s) 360 and/or friction device(s) 370 to accurately replicate water resistance like rowing/boating on water. The rowing assembly 220 may include weight(s)/weight holding structure ("weight(s)/holder(s)") 380 (e.g., pocket or other weight holding structure) behind and/or along sides of the movable user support 155 to add weights to generate more load for legs. The rowing assembly 220 may include weights/weight holding structure weight(s)/holder(s) 380 behind, in front, and/or along sides of the foot plates/pedals 165 to generate more load for arms. The rowing assembly 220 may include a spiral winding pulley 390 to change the ratio as a function of stroke for providing variable resistance. Top handle/third pulley 239 includes no mast, vertical mast, angled mast, and/or long mast. The handle assembly 240 dangles loose from the angled support tower 234. The angled support tower 234 includes a catch that the handle assembly 240 is stowed in when not in use. An upper end of rail(s) 156 is supported by single or dual strut/leg support assembly 55, which may be adjustable or fixed. The inclined rail(s) 156 is/are dual, mono, and/or curved. The rail(s) can also be horizontal. In the horizontal orientation, all resistance is created by any combination of means mentioned herein except for bodyweight. The rowing exercise device 105 includes a computer/computer display assembly 237 that displays all metrics discussed herein as well. The computer display assembly 237 is on the angled support tower/mast 234 or is disposed in a low position to protect against accidental flying handle assembly 240. The movable user support 155 is made with two padded surfaces, 1 pad+1 foam or plastic back support, or is a flexible plastic seat. The movable user support 155 may be connected to the cable 238 so that it is pulled by the cable 238 towards the movable foot support 230.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A rowing exercise device, comprising:

a support structure including one or more inclined rails;

a movable user support movably associated with the one or more inclined rails of the support structure for movement relative to and along the one or more inclined rails of the support structure;

a movable foot support movably associated with the one or more inclined rails of the support structure for movement relative to and along the one or more inclined rails of the support structure;

a handle;

a rowing assembly operatively associated with the handle and at least the movable foot support to cause at least the movable foot support to move relative to and along the one or more inclined rails of the support structure with movement of the handle so that both a user's body and feet move relative to the one or more inclined rails of the support structure with movement of the handle, wherein the rowing assembly is configured to provide rowing resistance that is majority bodyweight resistance, wherein the movable user support and movable foot support move relative to each other along the one or more inclined rails of the support structure.

2. The rowing exercise device of claim 1, wherein the movable user support moves up the one or more inclined rails with concentric exercise movement of the handle and moves down the one or more inclined rails with eccentric exercise movement of the handle.

3. The rowing exercise device of claim 1, wherein the one or more inclined rails are one of entirely straight, partially curved, fixed, and adjustable.

4. The rowing exercise device of claim 1, wherein the rowing assembly includes an upper end with one or more pulleys.

5. The rowing exercise device of claim 1, wherein the rowing exercise device is inclinably adjustable to adjust an incline of the one or more inclined rails.

6. The rowing exercise device of claim 1, wherein the one or more inclined rails include opposite ends and the movable foot support is lockable to the one or more inclined rails adjacent to one of the opposite ends so that the rowing exercise device can be stored by standing it up on its end adjacent to the movable foot support.

7. The rowing exercise device of claim 1, wherein the handle includes a pair of handles, one for each hand of a user.

8. The rowing exercise device of claim 1, wherein the movable foot support includes a pair of movable foot supports, one for each foot of a user.

9. The rowing exercise device of claim 1, wherein the rowing assembly includes one or more resistance increasing mechanisms to increase rowing exercise resistance in the rowing exercise device.

10. The rowing exercise device of claim 9, wherein the one or more resistance increasing mechanisms are selected from the group consisting of one or more springs, one or more elastic structures, one or more weight holding structures and one or more weights.

11. The rowing exercise device of claim 1, wherein the rowing assembly includes one or more dynamic resistance mechanisms.

12. The rowing exercise device of claim 1, wherein the one or more dynamic resistance mechanisms are selected from the group consisting of one or more flywheels, one or more electromagnetic devices, one or more hydraulic devices, one or more pneumatic devices, one or more friction devices, and one or more spiral winding pulleys.

13. The rowing exercise device of claim 1, wherein the movable foot support includes a mast, and includes at least one cable operably associated with the handle and the rowing assembly extending through the mast.

14. The rowing exercise device of claim 13, wherein the mast is one of a vertical mast, an angled mast, and a long mast.

15. A method of rowing using the rowing exercise device of claim 1, comprising:

supporting one's body on the movable user support with the movable user support in a mount and dismount position;

receiving one's feet with one's legs bent on the movable foot support with the movable foot support in a mount and dismount position;

receiving one's hands with one's arms substantially straight on the handle assembly;

the rowing assembly causing the movable foot support receiving one's feet to move from the mount and dismount position to a finish position, relative to the support structure, providing concentric rowing exercise, by one pulling on the handle assembly with one's hands and bending one's arms;

the movable user support moving from the mount and dismount position to a finish position by one extending one's legs as the movable foot support moves, causing the movable user support to move away from the movable foot support.

16. The method of claim 15, further including:

the rowing assembly causing the movable foot support receiving one's feet to move from the finish position to the mount and dismount position, relative to the support structure, providing eccentric rowing exercise, by straightening one's arms while holding onto the handle assembly with one's hands;

the movable user support moving from the finish position to the mount and dismount position by one bending one's legs as the movable foot support moves, causing the movable user support to move towards the movable foot support.

* * * * *